US005692533A

United States Patent [19]

Meltzer

[11] Patent Number: 5,692,533

[45] Date of Patent: Dec. 2, 1997

[54] WALKING CANE INCLUDING FUNCTION ENHANCING ELEMENTS

[75] Inventor: Bryant K. Meltzer, Hollywood, Fla.

[73] Assignee: Cane Enable, Inc., Hollywood, Fla.

[21] Appl. No.: 498,565

[22] Filed: Jul. 6, 1995

Related U.S. Application Data

[63] Continuation-in-part of Ser. No. 377,854, Jan. 25, 1995, abandoned.

[51] Int. Cl.[6] ..... A45B 1/00

[52] U.S. Cl. ..... 135/65; 135/85

[58] Field of Search ..... 135/65, 66, 67, 135/77

[56] References Cited

U.S. PATENT DOCUMENTS

| | | | |
|---|---|---|---|
| 2,811,978 | 11/1957 | Russell | 135/65 |
| 2,886,047 | 5/1959 | Healy . | |
| 3,289,685 | 12/1966 | Parker | 135/65 |
| 4,044,784 | 8/1977 | Smith | 135/65 X |
| 4,274,430 | 6/1981 | Schaaf et al. | 135/65 |
| 4,800,910 | 1/1989 | Gamm | 135/67 |
| 4,997,001 | 3/1991 | DiCarlo | 135/65 |
| 5,224,506 | 7/1993 | Allen et al. | 135/77 X |
| 5,238,013 | 8/1993 | Battiston et al. | 135/77 X |
| 5,311,880 | 5/1994 | Lamcaster et al. | 135/67 X |
| 5,390,687 | 2/1995 | Tsai | 135/65 |

*Primary Examiner*—Lanna Mai
*Attorney, Agent, or Firm*—M. K. Silverman

[57] ABSTRACT

A walking cane includes function enhancing elements, the cane including a sing of a substantially vertical elongated support member having an upper end, a lower end and a longitudinal axis. A handle is complementally positioned about the support member's upper end for selectable radial rotation relative to the longitudinal axis thereof. Forward and rear and downwardly integrally dependent legs rigidly extend from the support member's lower end, the legs each having a body portion and foot portions. The wheels are rotatably secured to each of the foot portions of the forward legs of a base, and friction-enhancing tips are integrally associated with each of the foot portions of the rearward legs of the base.

12 Claims, 3 Drawing Sheets

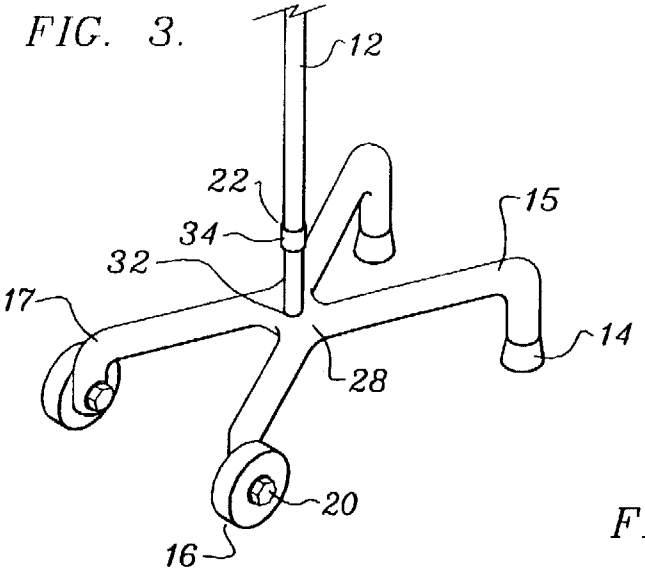
FIG. 3.
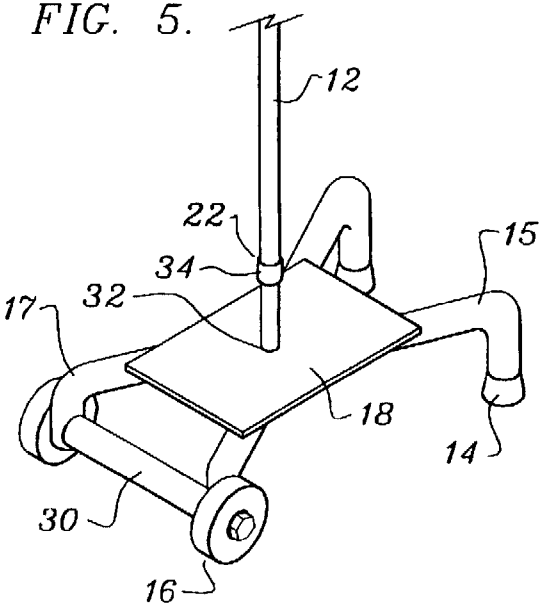
FIG. 5.
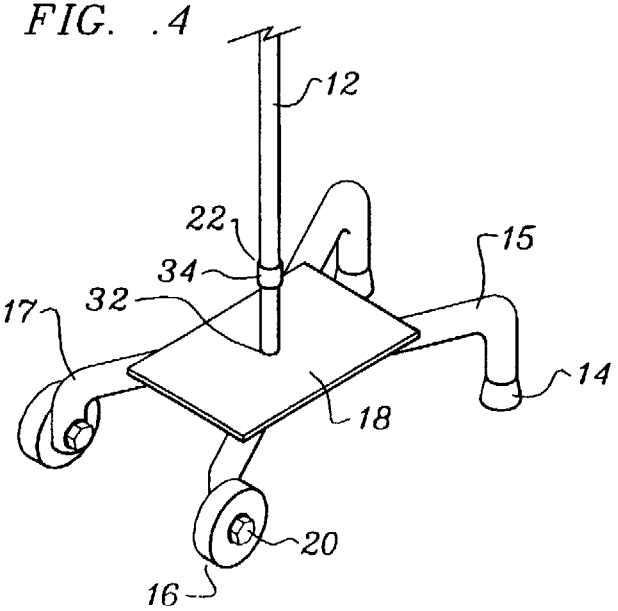
FIG. .4

WALKING CANE INCLUDING FUNCTION ENHANCING ELEMENTS

REFERENCE TO RELATED APPLICATION

This invention is a continuation-in-part of application Ser. No. 08/377,854, filed Jan. 25, 1995, abandoned, entitled Rolling Quad Cane.

BACKGROUND OF THE INVENTION

With the increases in life expectancy which have resulted from medical advances, a larger proportion of the population lives to an advanced age. As a result, there is now a larger proportion of aged and infirm people than were previously.

Aged or infirm persons have needs which are different than those of the general population. In particular, such persons may frequently require the assistance of a special device to walk with safety. Among such devices, which are known to the prior art, are walking aid canes in which the base of the cane is broadened by the addition thereto of four legs to provide a firmer base for the cane to prevent the user from falling.

In previous walking aid canes, the leg members of the cane generally projected upwardly and inwardly at an angle from a supporting surface with the leg members connected at their upper ends to an upwardly extending central support post. The legs of such canes formed what may be termed a pyramidal configuration. While such canes have been somewhat satisfactory, they have suffered from a number of drawbacks. With the cane legs forming a pyramidal configuration, the center of gravity of the cane is relatively high so that the cane may be tipped over to permit falling of the user. Further, the pyramidal configuration of the cane legs has interfered with the user's foot and leg movements with the user's foot in close proximity to the cane.

A further disadvantage of previous walking aid canes is that the handle member of the cane is restricted in its vertical positioning by a vertically elevated connection point between the upper end of the inwardly angled cane legs and the cane support member. The handle member of the cane will, generally, be mounted in telescoping relation with respect to the cane support member. However, due to the vertically elevated connection point between the cane legs and support member, the downward adjustment of the handle member is limited by the vertically elevated connection point which prevents downward movement of the handle member beyond this point.

The present invention addresses the above deficiencies in the art by providing relates to an article with the a walking cane in which two front legs of a four-legged base of a walking cane allow a person to use the stability of a so-called quad cane in walking while allowing the cane to be easily maneuverable through tilting the quad cane forward onto its front wheels and allowing the cane to be rolled forward, instead of being dragged. This invention provides a significant improvement in that a person can have all of the benefits of a quad cane, which is often very heavy due to its large four-legged base, without having to drag the cane, that is, one may tilt the cane forward and push along the cane as the cane rolls on the front two wheels on the legs thereof.

The specific prior art, as is known to the inventor, is reflected in U.S. Pat. No. 4,941,496 to Berning teaches a walker with pivoting wheels on the forward ends of horizontal members at the bottom of the walker. The pivoting wheels serve as and aid for mobility of the walker, primarily in ascending stairs. The walker with pivoting wheels is larger, heavier and bulkier than is the present invention and, therefore, is far less easily mobile as the present invention.

U.S. Pat. No. 4,997,001 to DiCarlo teaches a convertible cane which is convertible between a single-tipped cane and a multi-tipped cane through the use of a fastener at the nexus of the multi-tipped base. The convertible cane does not have any wheels on the multiple tips and is thus, solely for support, and not for ease of mobility as is the present invention.

U.S. Pat. No. 4,044,784 to Smith which teaches a walking aid cane with a four legged-base. The four legs of the base all have blunt tips as the base functions solely for support. There are no wheels present on any of the legs as in the present invention and, thus, the ease of mobility in Smith is much lower.

U.S. Pat. No. 4,251,105 to Barker teaches a mobility aid having a four-legged walking frame with wheels on the front legs of the walking frame. The walking frame is much larger, heavier and bulkier than is the present invention, therefore, even with the added mobility of the front wheels, the walking aid frame is not as easy mobile as is the present invention.

U.S. Pat. No. 3,289,685 to Parker teaches a step-stick walking aid with interchangeable bases, including a four pointed base, and adjustable height. The step-stick walking cane does not have a plurality of legs to aid in support and only teaches a four-pointed base, which does not form an integral structure of the cane, and is thus, not as rigid as the present invention. Further, the step-stick walking aid does not have any wheels at its base and is therefore, less mobile than the present invention.

U.S. Pat. No. 2,244,869 to Everest et al. teaches a glider cane with a plurality of legs, widely spaced apart, with wheels on the inside two legs and blunt tips on the remaining legs. The glider cane has a much larger base than the present invention and is thus, less maneuverable and bulkier than the present invention. Furthermore, the wheels are on the legs facing the user of the glider cane and consequently, the user has to lean way from the cane to use the wheels for mobility and towards the cane to gain full support and friction from the other legs. A user of the present invention need only to slightly push forward to gain the mobility of the wheels in the present invention and need only to increase support pressure to the vertical support member of the present invention to gain the full support of all legs.

U.S. Pat. No. 5,271,422 to Sorrell et al. teaches a safety walker having resistance to backward motion, designed to aid patients in walking. The safety walker has wheels on tips of the back legs and blunt tips on the front legs. The safety walker also has a seat which prevents a patient from falling to the ground. The safety walker is much larger, heavier and bulkier than the present invention and is thus, far less mobile than the present invention.

U.S. Pat. No. 5,390,687 to Tsai teaches a quadruped stick with detachable quadrupeds. The quadrupeds are preferably made of metal while the base of the stick is made of plastic. All of the quadrupeds have blunt tips and no wheels, thus, such a stick has less ease of mobility than does the present invention.

French Patent No. 2,612,476 teaches a combination shopping trolley and walking stick. The walking stick attaches to a base which has wheels at all four corners while a shopping bag rest upon the base while attached to the upper end of the shaft of the cane portion of the trolley. The walking aid/shopping trolley has a very large base in order to support the shopping bag and is larger, heavier and bulkier and is thus, less easily mobile as is the present invention. Further, the walking aid/shopping trolley does no have any blunt tips, or braking mechanism to prevent the walking aid/shopping trolley from sliding when persons place their full support on the cane portion. The rearward legs of the present invention cause braking of the present invention when a persons place their full support on the walking cane.

None of these, nor other references known to the inventor, treat the problem addressed by the present invention, that is, providing a compact walking cane which provides rigid stationary support, while allowing ease of mobility of the cane.

SUMMARY OF THE INVENTION

The instant invention relates to a walking cane including function enhancing elements. The cane comprises a substantially vertical elongated support member having an upper end, a lower end and a longitudinal axis thereof. It also includes handle complementally positioned about the support members' upper end for selectable radial rotation relative to the longitudinal axis of said support member. Also provided are plurality of forward and rearward downwardly integrally dependent legs which rigidly extend from the lower member of the support member, each of such legs having a body and foot portion thereof. Wheels are rotatably secured to each of the foot portions of the forward legs of the support member, and friction-enhancing tips are integrally associated with each of the foot portions of the rearward legs of the support member.

It is an object of the invention to provide a means a walking cane with a rigid base of stationary support while allowing the cane providing enhanced support and mobility.

It is another object to provide a means of the above type having a compact design and simplicity of manufacturing.

The above and yet other objects and advantages of the invention will become apparent from the hereinafter set forth Brief Description of the Drawings, Detailed Description of the Preferred Embodiment and Claims appended herewith.

BRIEF DESCRIPTION OF THE DRAWINGS

FIG. 3 is a perspective view of the legs integral to the vertical support member embodiment of the walking cane.

FIG. 4 is a perspective view of the horizontal base embodiment thereof.

FIG. 5 is an exploded view of the wheels embodied as being attached individual to a forward legs' foot.

FIG. 6 is a perspective view of the wheel integral to an axle which is attached to the forward legs' foot.

DETAILED DESCRIPTION OF THE INVENTION

Figure 1:
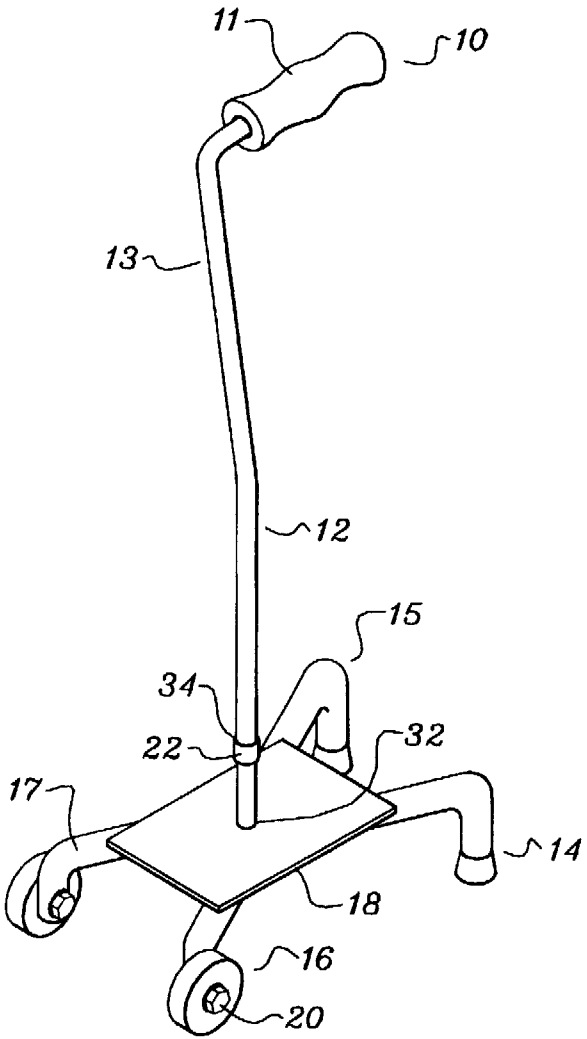
FIG. 1 is a perspective view of the walking cane.
Figure 1A:
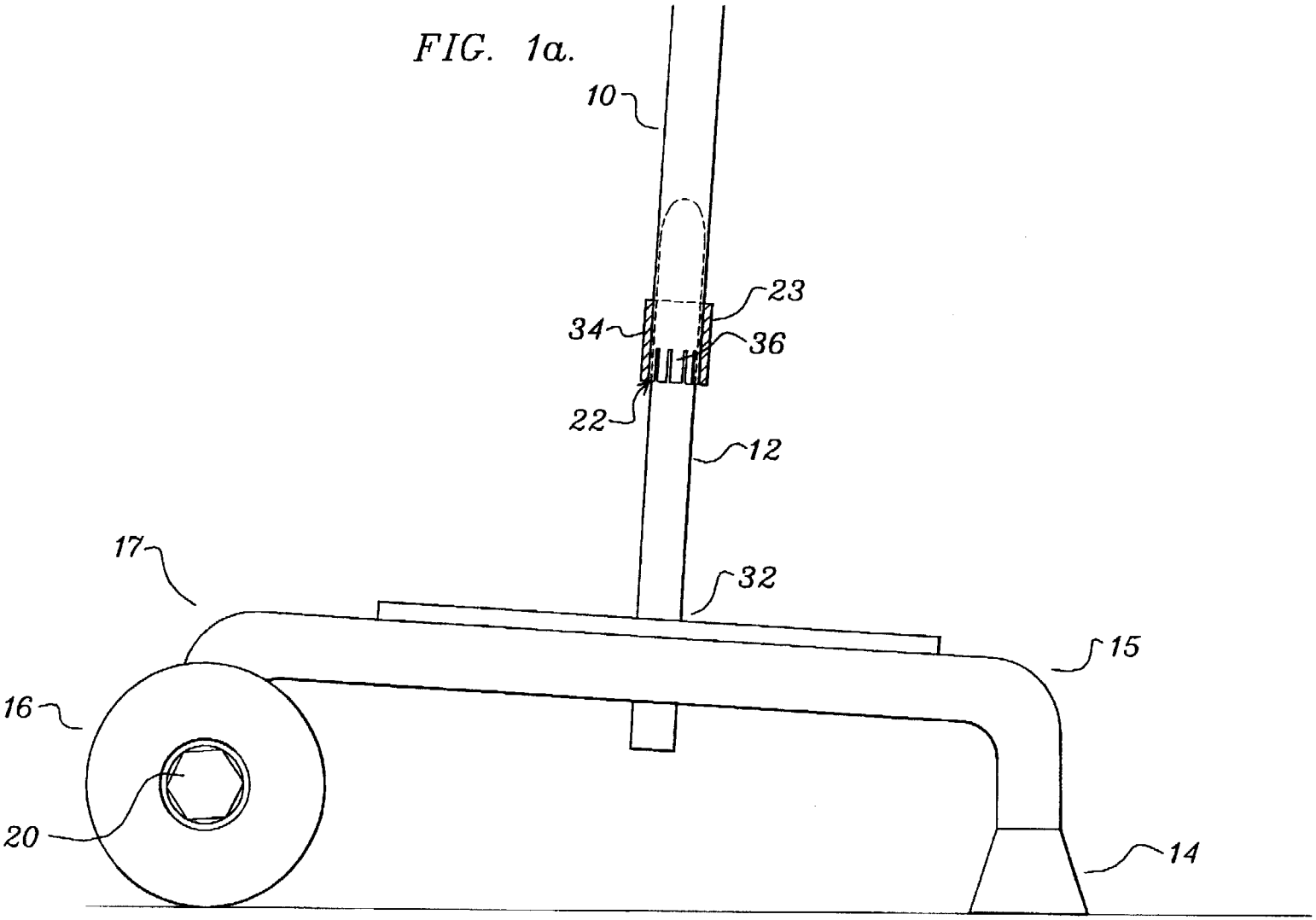
FIG. 1*a* is a side view of the base of the walking cane.

As illustrated in FIGS. 1 and 1A, the inventive walking cane includes a vertical support member 12, handle means 10 complementally positioned about said support members' upper end, means 23 for adjusting said handle means 10 either vertically or angularly relative to the four legs which include two forward legs 17 and two rearward legs 15, rigidly downwardly dependent from said vertical support member 12 with wheels 20 on foot portions of the forward legs 17 and blunt tips 14 on foot portions of the rearward legs 15.

The cane is preferably constructed of hollow metal tubing, preferably aluminum or a lighter gauge of steel to minimize the overall weight of the cane, such tubing ranging in diameter from 0.75 inch to about 1.5 inches, with one inch being most preferable.

The handle means 10 is constructed of tubing slightly greater in inside diameter than the tubing of the vertical support member 12. At the handle means 10 lower end 22 are said means 23 to adjustably slidably fasten the handle means 10 relative to vertical support member 12, as is illustrated in FIG. 1A. These fastening means may comprise an adjustable sleeve 34 in which one only need tighten or the sleeve loosen the sleeve against a high friction surface for ease of turning, in order to raise or lower the handle means. The sleeve 34, through rotation, affects the inward pressure on metal extensions 36 at the lower end 22 of the handle means 10. Said metal extensions 36 frictionally retard the handle means 10 from sliding about the vertical support member 12.

A variant of the means for adjustably slidably fastening the handle means 10 to the vertical support member 12 may be a peg-in-hole system, as disclosed in U.S. Pat. No. 4,044,784 to Smith.

The handle means 10 is vertically adjustable, preferably in a range of height from about 2.5 feet to about 4 feet. A handle portion 11 of the handle means 10 may be rotationally adjusted in 360 degrees in a radial plane relative to the longitudinal axis of vertical support member 12.

Figure 2:
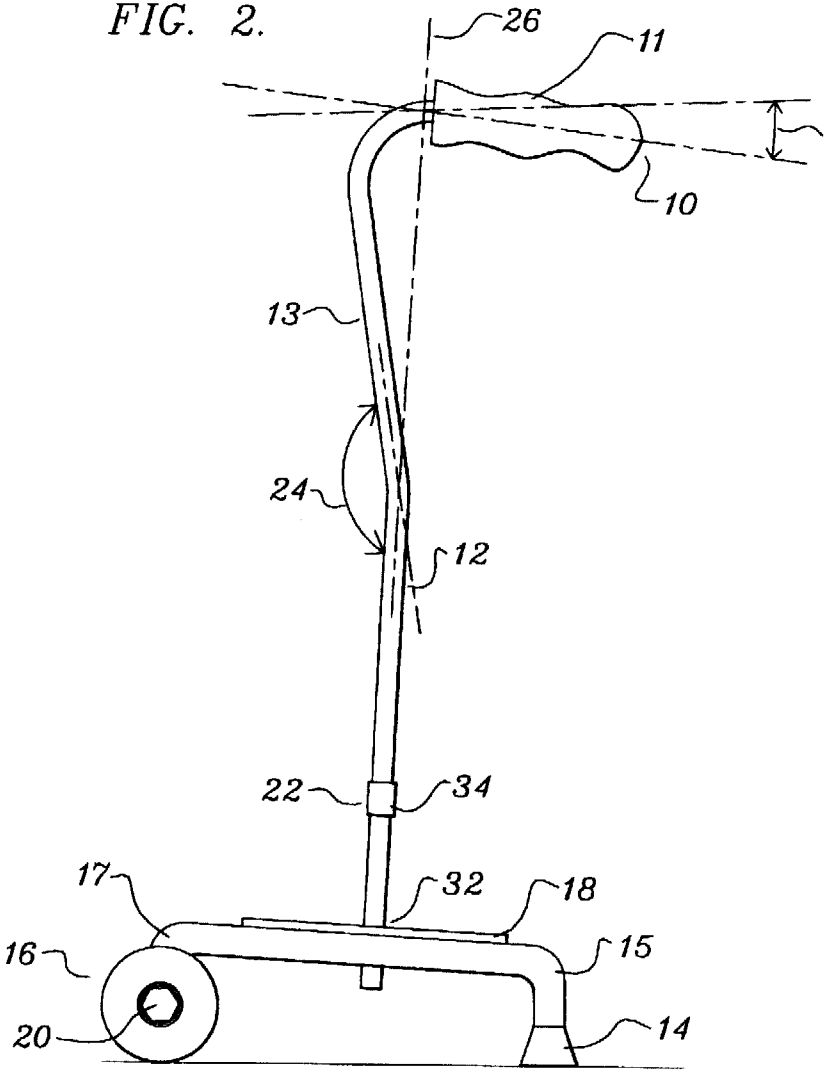
FIG. 2 is a side view thereof.

As illustrated in FIG. 2, the handle portion 11 of the handle means 10 is preferably constructed of neoprene or rubber and shaped to allow a hand to easily grip the handle. The handle portion 11 is angled at angle 25 which is preferably in a range of about 0 degrees to 30 degrees, with 10 degrees being preferable. The handle means 10 also include a forward bent portion 13 to allow the handle portion 11 to align on the same vertical axis 26 as nexus 32 between the vertical support member 12 and the forward leg 17 and rearward 15 legs. This allows any downward pressure placed upon the handle portion 11 to be equally beared by the forward 17 and rearward 15 legs. The angle of the forward bend 24 is preferably in a range of about 5 degrees to 30 degrees, with 10 degrees being most preferable. The forward tilt of the handle means 10 is then corrected by the handle portion 11 of the handle means 10.

The forward legs 17 and rearward legs 15 may be integrated at the nexus 32 with the vertical support member 12, as illustrated in FIG. 3. In another embodiment, the forward legs 17 and rearward legs 15 may be rigidly integrated into a substantially horizontal base 18 which forms the nexus 32 to the lower end 22 of the vertical support member 12, as illustrated in FIG. 4.

The forward legs 17 have wheels 16 at their foot portions. The wheels 16 are preferably made of a high endurance plastic which can withstand the friction of rolling with minimal wear. The wheels 16 may be attached to the foot portion of the forward legs 17 individually, with fastening means 20, as illustrated in FIG. 4. In another embodiment, the wheels 16 may be rigidly attached to an axle 30 which spans between the foot portions of the forward legs 17, as illustrated in FIG. 5. In this embodiment, the axle 30 can aid in bracing the lower structure of the cane through its bearing of some of the pressure which, otherwise, the individually attached wheels 20 would bear.

The rearward legs 15 have blunt tips 14 at their foot portion. The blunt tips 14 are made of a friction-enhancing material which maximizes frictional contact between the tips 14 and the ground to help stabilize the cane from forward motion when downward pressure is exerted on the handle means 10 and the vertical support means 12 thereof.

While there has been shown and described the preferred embodiment of the instant invention it is to be appreciated that the invention may be embodied otherwise than is herein specifically shown and described and that, within said embodiment, certain changes may be made in the form and arrangement of the parts without departing from the underlying ideas or principles of this invention as set forth in the Claims appended herewith.

Having thus described my invention, what I claim as new, useful, and non-obvious and, accordingly, secure by Letters Patent of the United States is:

1. A walking cane, including function enhancing elements, comprising:

(a) a substantially vertical elongated support member having an upper end, a lower end and a longitudinal axis thereof;

(b) handle means, complementally positioned about said support member's upper end, for selectable radial rotation relative to said longitudinal axis of said support member;

(c) a plurality of forward and rearward downwardly integrally dependent legs rigidly extending from said support member's lower end, said legs each having a body portion and foot portion thereof;

(d) wheel means rotatably secured to each of said foot portions of said forward legs; and (e) friction-enhancing tips integrally associated with each of said foot portions of said rearward legs.

2. The cane as recited in claim 1, in which said plurality of forward dependent legs comprises:

two legs and said plurality of rearward dependent legs also comprises two legs.

3. The cane as recited in claim 1, in which said rotatably secured wheel means comprise:

at least one wheel attached to each of said forward legs of said base.

4. The cane as recited in claim 1, in which said rearward legs comprise:

blunt tips formed of a high friction inducing material and in which a bottom-most portion of each of said tips defines a surface for enhancing frictional contact between said surface and the ground.

5. The cane as recited in claim 1, in which said handle means include means for selectable rotation thereof relative to said vertical support member.

6. The cane as recited in claim 5, in which said handle means defines an angle in the range of 0 to 30 degrees relative to a plane radial to said longitudinal axis of said vertical support member relative to a bottom-most complemental engagement portion of said handle means.

7. A walking cane, including function enhancing elements comprising:

(a) a substantially vertical elongated support member having an upper end, a lower end and longitudinal axis thereof;

(b) handle means, complementally positioned about said support member's upper end, for selectable radial rotation relative to said longitudinal axis of said support member;

(c) a substantially horizontal base rigidly connected to said vertical support member's said lower end;

(d) a plurality of forward and rearward downwardly integrally dependent legs extending from said base, said legs each having a body portion and a foot portion thereof;

(e) wheel means rotatably secured to each of said foot portions of said forward legs of said base; and (f) friction-enhancing tips integrally associated with each of said foot portions of said rearward legs of said base.

8. The cane as recited in claim 7, in which said plurality of forward dependent legs comprises:

two legs and said plurality of rearward dependent legs comprises two legs.

9. The cane as recited in claim 7, in which said rotatably secured wheel means comprise:

at least one wheel attached to each of said forward legs of said base.

10. The cane as recited in claim 7, in which said rearward legs comprise:

blunt tips formed of a high friction-inducing material and in which a bottom-most portion of each of said tips defines a surface for enhancing frictional contact between said surface and the floor.

11. The cane as recited in claim 7, in which said handle means include means for selectable rotation thereof relative to said vertical support member.

12. The cane as recited in claim 7, in which said handle means defines an angle in the range of 0 to 30 degrees relative to a plane radial to said longitudinal axis of said vertical support member relative to a bottom-most complemental engagement portion of said handle means.

* * * * *